US006891532B2

(12) United States Patent
Nara et al.

(10) Patent No.: US 6,891,532 B2
(45) Date of Patent: May 10, 2005

(54) APPARATUS AND METHOD FOR INSPECTING PICTURE ELEMENTS OF AN ACTIVE MATRIX TYPE DISPLAY BOARD

(75) Inventors: Shouji Nara, Kanagawa (JP); Masatoshi Itoh, Kanagawa (JP); Makoto Ookuma, Kanagawa (JP)

(73) Assignee: Wintest Corporation (JP)

( * ) Notice: Subject to any disclaimer, the term of this patent is extended or adjusted under 35 U.S.C. 154(b) by 303 days.

(21) Appl. No.: 10/128,031

(22) Filed: Apr. 22, 2002

(65) Prior Publication Data

US 2002/0154108 A1 Oct. 24, 2002

(30) Foreign Application Priority Data

Apr. 23, 2001 (JP) ..... 2001-124227

(51) Int. Cl.[7] ..... G09G 5/00

(52) U.S. Cl. ..... 345/204; 345/690; 345/207

(58) Field of Search ..... 345/204, 211, 345/87–100, 102, 207, 214, 904, 690, 93; 348/246, 247

(56) References Cited

U.S. PATENT DOCUMENTS

| | | | | |
|---|---|---|---|---|
| 5,969,709 A | * | 10/1999 | Kim | 345/690 |
| 6,295,041 B1 | * | 9/2001 | Leung et al. | 345/89 |
| 6,549,183 B1 | * | 4/2003 | Koyama | 345/92 |
| 6,556,180 B1 | * | 4/2003 | Furuhashi et al. | 345/87 |
| 6,583,774 B1 | * | 6/2003 | Yoshida et al. | 345/55 |

FOREIGN PATENT DOCUMENTS

| | | |
|---|---|---|
| JP | 5-313132 | 11/1993 |
| JP | 6-43490 | 2/1994 |
| JP | 6-59283 | 3/1994 |
| JP | 7-287247 | 10/1995 |
| JP | 10-96754 | 4/1998 |
| JP | 10-214065 | 8/1998 |

* cited by examiner

*Primary Examiner*—Regina Liang
*Assistant Examiner*—Jennifer T. Nguyen
(74) *Attorney, Agent, or Firm*—Ostrolenk, Faber, Gerb & Soffen, LLP

(57) ABSTRACT

The present invention provides a picture element inspecting apparatus and method for an active matrix type display that is constituted by an LCD array device or an EL array device, which is capable of canceling the irregularities in source switches 13, the noise caused by device driving signals, and the irregularities in devices in the measurement apparatus, and enhancing the accuracy of a picture element inspection. The present invention is based on the finding that irregularities in the direction of the source lines 8 can be canceled by performing, in addition to a charging step and first sensing step that are realized by the charging and discharging of picture elements 2, a second sensing step in a state where gate lines are not selected, and subtracting correction picture element data thus obtained, and is characterized in that a subtraction operation is performed on effective picture element data obtained by electrically charging picture elements 2, and correction picture element data obtained in a state where gate lines 9 of picture elements 2 are not selected, and the quality of the picture elements 2 is determined based on the subtraction output.

28 Claims, 6 Drawing Sheets

APPARATUS AND METHOD FOR INSPECTING PICTURE ELEMENTS OF AN ACTIVE MATRIX TYPE DISPLAY BOARD

BACKGROUND OF THE INVENTION

1. Field of the Invention

The present invention is related to an apparatus and method for inspecting the picture elements of an active matrix type display, and more particularly to an apparatus and method for inspecting the picture elements of an active matrix type display, which is capable of enhancing picture element inspection accuracy upon picture element inspection of a liquid crystal display array (LCD array) or organic electro luminescent display array (EL array) having active matrix structures by canceling source switching element irregularities, measurement noise attributed to device drive signals, and irregularities in various elements in the measurement system.

2. Description of the Related Art

A conventional LCD array device and EL array device were assembled into respective modules, and a 100% inspection was performed by human visual observation.

In this inspection, a problem is that if the product is not assembled into its final form, an image cannot be displayed, and consequently, large expenses are incurred for nothing when a defect occurs, and, in addition, another problem is that inspection results are not reliable due to the fact that, because they are subjective inspections done by the naked eye, the evaluation criteria used by various inspectors are apt to lack uniformity, and inspection accuracy can be off the mark as a result of human fatigue.

Further, in an electrical automatic inspection apparatus and method, a certain electrical charge is applied to each picture element of an LCD array device and an EL array device, which are the devices targeted for inspection, and each picture element is inspected for malfunctions, broken wires, shorts and other such defects by reading this charge outside the device and evaluating the absolute value of the quantity of this charge.

However, the problem is that, in LCD display devices or EL display devices currently being developed, due to the high-temperature polysilicon processes and the low-temperature polysilicon processes which have come to be used in recent years, the irregularities in the characteristics of various elements inside a device resulting from manufacturing process-related problems are great.

A general explanation of a conventional liquid crystal display device, which constitutes the device to be inspected, will be given based on FIG. 6.

FIG. 6 is a diagram of an equivalent circuit of a polysilicon liquid crystal display 1 (active matrix type display), and polysilicon liquid crystal display 1 has a display device portion 3, in which a plurality of picture elements 2 are aligned in a matrix in the X-Y directions by LCD elements, and a horizontal driving circuit 4 and a vertical driving circuit 5 of the display device portion 3.

Each picture element 2 has an LCD element 6 and a switching element 7 (TFT: thin-film transistor), the respective sources of switching elements 7 are connected to horizontal driving circuit 4 via a plurality of source lines 8 (column select lines), and, in addition, the respective gates of switching elements 7 are connected to vertical driving circuit 5 via a plurality of gate lines 9 (row select lines). A picture element 2 is arranged at each intersecting portion 10 of the source lines 8 and gate lines 9.

Furthermore, polysilicon liquid crystal display 1 can be either a device in a state prior to encapsulating a liquid crystal in the LCD elements 6 thereof (that is, an active matrix type display board), or a device of a state subsequent to encapsulating a liquid crystal in the LCD elements 6 thereof (that is, an active matrix type display), and both of these can be treated as devices to be inspected.

Display device portion 3 can be treated as a device to be inspected independently, and, in addition, display device portion 3 can also be treated as a device to be inspected in a state in which it has been combined with at the least one side of either horizontal driving circuit 4 or vertical driving circuit 5.

Horizontal driving circuit 4 has a horizontal shift register 11, a video signal supply terminal 12, and a number of source switches 13 (column select switches, FET: field effect transistor) that corresponds to the number of columns of the display device portion 3 (9, from A1–A9, in the example shown in the figure).

Horizontal shift register 11 has a horizontal start signal (X-ST) supply terminal 14, a horizontal clock signal (X-CLK) supply terminal 15, and a number of horizontal flip-flop circuits 16 that corresponds to the number of columns of the display device portion 3 (3 in the example shown in the figure).

Video signal supply terminal 12 has an R video signal (VIDEO-R) supply terminal 17, a G video signal (VIDEO-G) supply terminal 18, and a B video signal (VIDEO-B) supply terminal 19.

Source switches 13 are connected between source lines 8 and horizontal shift register 11, and video signal supply terminal 12, and each column in display device portion 3 is selected by switching a source signal to a picture element 2.

Vertical driving circuit 5 has a vertical shift register 20, and vertical shift register 20 has a vertical start signal (Y-ST) supply terminal 21, a vertical clock signal (Y-CLK) supply terminal 22, and a number of vertical flip-flop circuits 23 that corresponds to the number of rows of the display device portion 3 (4 in the example shown in the figure).

In a conventional electrical automatic inspection device (not shown in the figure), which has a polysilicon liquid crystal display 1 of a configuration such as this as the device to be inspected, inspection is performed by applying a certain charge to each picture element 2, reading this charge in the exterior of the polysilicon liquid crystal display 1, and evaluating the absolute value of the quantity of this charge.

However, the problem is that, in polysilicon liquid crystal display 1 according to LCD display devices manufactured by either a high-temperature polysilicon process or a low-temperature polysilicon process, there are large characteristic irregularities in the various elements internal thereto due to problems related to the manufacturing process.

In particular, irregularities in the elements of source switches 13 (A1–A9) cannot be ignored, and the vertical stripes of when sampling a waveform outputted to an inspection device, which are the cause of these relatively large irregularities in source switches 13, are a big problem, and in an inspection method, wherein the absolute quantity of a read-out charge is evaluated simply, since there are numerous cases in which the side of the noise level resulting from these irregularities is larger than the level of the inspection signal, the results pose problems from the standpoint of inspection accuracy.

These source switch 13 irregularities are generated primarily by the nonuniformity of capacitance between a gate and a source brought on by the nonuniformity of ON resistance of each FET and the nonuniformity of the gate insulating film of each FET, and the nonuniformity of total impedance to picture element capacitance (LCD device 6) caused by interconnect resistance brought on by irregularities of delays between horizontal flip-flop circuits 16, which control the respective source switches 13, and the respective gate terminals, and different distances to the respective source switches 13 from terminals for flexible cable connections (not shown in the figure), resulting from the fact that a laser beam could not be uniformly irradiated over the entire device in the laser annealing process for growing a small amorphous silicon crystal up to a state, wherein it can be called a polysilicon.

Moreover, the problem is that, in line with making LCD and EL devices larger in recent years, each of these nonuniform items is moving in a direction in which the degree of this nonuniformity is increasing.

Further, when discharging the charge that is built up inside each picture element 2 inside a device (polysilicon liquid crystal display 1) being inspected, and sampling the discharge waveform thereof, a gate drive waveform, which leaks out through gate-source capacitance from the gate of each source switch 13 inside polysilicon liquid crystal display 1, and the crosstalk components of horizontal clock signals for driving horizontal shift register 11 are superimposed at the same timing as a picture element signal, and when the rising/falling edge of a vertical clock signal coincides with an image period, this also generates crosstalk, constituting factors that drastically lower the accuracy of picture element inspection.

A problem is that this crosstalk problem is becoming more apt to occur in line with making the polysilicon liquid crystal display 1 larger and higher in density.

Furthermore, when the noise originating in device drive signals from horizontal driving circuit 4 and vertical driving circuit 5, as well as the level of irregularities in each element of a test head or measurement device (not shown in the figure) is larger than a picture element inspection signal, there is the problem that the picture element inspection signal gets buried between such noise or irregularities levels, making detection impossible.

Furthermore, on the subject of picture element inspection devices for various displays, there are Japanese Patent Laid-open No. 5-313132, Japanese Patent Laid-open No. 6-43490, Japanese Patent Laid-open No. 6-59283, Japanese Patent Laid-open No. 7-287247, Japanese Patent Application Laid-open No. 10-96754, and Japanese Patent Application Laid-open No. 10-214065.

SUMMARY OF THE INVENTION

With the foregoing problems in view, it is an object of the present invention to provide an apparatus and a method for inspecting picture elements of an active matrix type display, which, when inspecting an active matrix type display based on either an LCD array device or an EL array device, is capable of enhancing the accuracy thereof.

Further, an object of the present invention is to provide an apparatus and a method for inspecting picture elements of an active matrix type display, which cancels irregularities in source switches, noise originating in device drive signals, and irregularities of elements in the measurement device, and is capable of ensuring predetermined picture element inspection accuracy.

Further, an object of the present invention is to provide an apparatus and a method for inspecting picture elements of an active matrix type display, which enable highly accurate inspections by reducing the effects on captured data resulting from source switch irregularities, and, in addition, simultaneously reducing the effects of crosstalk from a horizontal driving circuit and horizontal clock line (horizontal clock signal supply terminal) or vertical driving circuit and vertical clock line (vertical clock signal supply terminal).

Further, an object of the present invention is to provide an apparatus and a method for inspecting picture elements of an active matrix type display, which enable picture element inspection with predetermined accuracy for an LCD array device or an EL array device by a simple arithmetic process (subtracting step).

That is, the present invention is based on the finding that, when inspecting the respective picture elements of an active matrix type display based on an LCD array and EL array of an active matrix structure, irregularities and the like in the direction of the source lines (or, as needed, in the direction of the gate lines) of a device to be inspected can be canceled by performing a sensing operation (a second sensing step) in a state where gate lines are not selected, in addition to the ordinarily performed charging operation (charging step) and sensing operation (a first sensing step) for obtaining so-called effective picture element data by the charging and discharging of respective picture elements, and subtracting the picture element data (correction picture element data) thus obtained. Therefore, a first invention is a picture element inspecting apparatus for an active matrix type display, for determining the quality of picture elements of a device to be inspected that is either an active matrix type display in which the picture elements are arranged at the respective intersecting portions of a plurality of column select lines and a plurality of row select lines into a matrix shape and the picture elements can be driven by a horizontal driving circuit and a vertical driving circuit, or a display board thereof, wherein a subtraction operation is performed on effective picture element data obtained as a discharge waveform from said picture elements by electrically charging said picture elements of said device to be inspected using said horizontal driving circuit and said vertical driving circuit, and correction picture element data obtained from said picture elements in a state where either said row select lines or said column select lines of the picture elements are not selected after acquiring said effective picture element data, and the quality of said picture elements is determined based on this subtraction output thus obtained.

A second invention is a picture element inspecting apparatus for an active matrix type display, for determining the quality of picture elements of a device to be inspected that is either an active matrix type display in which the picture elements are arranged at the respective intersecting portions of a plurality of column select lines and a plurality of row select lines into a matrix shape and the picture elements can be driven by a horizontal driving circuit and a vertical driving circuit, or a display board thereof, said picture element inspecting apparatus comprising: a subtracting circuit for performing a subtraction operation on effective picture element data from said picture elements driven by said driving circuits and correction picture element data obtained by driving the picture elements in a state where either said row select lines or said column select lines of the picture elements are not selected; and a defect determining circuit for determining the quality of the picture elements based on the subtraction output from this subtracting circuit.

A third invention is a picture element inspecting apparatus for an active matrix type display, for determining the quality of picture elements of a device to be inspected that is either an active matrix type display in which the picture elements are arranged at the respective intersecting portions of a plurality of column select lines and a plurality of row select lines into a matrix shape and the picture elements can be driven by a horizontal driving circuit and a vertical driving circuit, or a display board thereof, wherein a subtraction operation is performed on effective picture element data obtained as a discharge waveform from said picture elements by electrically charging said picture elements of said device to be inspected using said horizontal driving circuit and said vertical driving circuit, and correction picture element data obtained as a signal waveform resulting from a reason other than the electric discharge from said picture elements by once again driving both said row select lines and said column select lines of the picture elements, without carrying out said charging operation after acquiring the effective picture element data, and the quality of said picture elements is determined based on the subtraction output thus obtained.

A fourth invention is a picture element inspecting apparatus for an active matrix type display, for determining the quality of picture elements of a device to be inspected that is either an active matrix type display in which the picture elements are arranged at the respective intersecting portions of a plurality of column select lines and a plurality of row select lines into a matrix shape and the picture elements can be driven by a horizontal driving circuit and a vertical driving circuit, or a display board thereof, said picture element inspecting apparatus comprising: a subtracting circuit for performing a subtraction operation on effective picture element data from said picture elements driven by said driving circuits, and correction picture element data obtained by once again driving both said row select lines and said column select lines of the picture elements after acquiring said effective picture element data; and a defect determining circuit for determining the quality of said picture elements based on the subtraction output from this subtracting circuit.

A fifth invention is a picture element inspecting apparatus for an active matrix type display, for determining the quality of picture elements of a device to be inspected that is either an active matrix type display in which the picture elements are arranged at the respective intersecting portions of a plurality of column select lines and a plurality of row select lines into a matrix shape and the picture elements can be driven by a horizontal driving circuit and a vertical driving circuit, or a display board thereof, said picture element inspecting apparatus comprising: an A/D converter for performing analog-to-digital conversion of signals from said device to be inspected, which is driven by said driving circuits; memory circuits for holding at the least one line's worth or more of data converted from analog to digital by this A/D converter; and an arithmetic circuit for calculating picture element data stored in these memory circuits, wherein the quality of picture elements is determined while canceling irregularities originating in either the direction of said column select lines or the direction of said row select lines in said device to be inspected.

A sixth invention is a picture element inspecting method for an active matrix type display, for determining the quality of picture elements of to a device to be inspected that is either an active matrix type display in which the picture elements are arranged at the respective intersecting portions of a plurality of column select lines and a plurality of row select lines into a matrix shape and the picture elements can be driven by a horizontal driving circuit and a vertical driving circuit, or a display board thereof, said picture element inspecting method comprising the steps of: performing a subtraction operation on effective picture element data obtained as a discharge waveform from said picture elements by electrically charging said picture elements of said device to be inspected using said horizontal driving circuit and said vertical driving circuit, and correction picture element data obtained from said picture elements in a state where either said row select lines or said column select lines of said picture elements are not selected after acquiring the effective picture element data; and determining the quality of said picture elements based on the subtraction output thus obtained.

A seventh invention is a picture element inspecting method for an active matrix type display, for determining the quality of picture elements of to a device to be inspected that is either an active matrix type display in which the picture elements are arranged at the respective intersecting portions of a plurality of column select lines and a plurality of row select lines into a matrix shape and the picture elements can be driven by a horizontal driving circuit and a vertical driving circuit, or a display board thereof, said picture element inspecting method comprising: a charging step for electrically charging said picture elements of said device to be inspected using said horizontal driving circuit and said vertical driving circuit; a first sensing step for acquiring effective picture element data from said picture elements following this charging step; a second sensing step for acquiring correction picture element data in a state where either said row select lines or said column select lines of said picture elements are riot selected; a subtracting step for performing a subtraction operation on said effective picture element data in said first sensing step and said correction picture element data in said second sensing step; and a determining step for determining the quality of said picture elements based on the subtraction output obtained in this subtracting step.

The present invention can be constituted so as to simultaneously cancel the effects of a horizontal driving signal and a horizontal clock signal in the above-mentioned column select lines, as well as that of a vertical clock signal in the above-mentioned row select lines, inside the above-mentioned device to be inspected.

The present invention can be constituted so as to simultaneously cancel the effects of a horizontal clock signal in the above-mentioned column select lines, as well as that of a vertical driving signal and a vertical clock signal in the above-mentioned row select lines, inside the above-mentioned device to be inspected.

The present invention can be constituted such that the above-mentioned respective picture elements have thin-film transistor switching elements, the above-mentioned column select lines are treated as source lines, which connect to the sources of these switching elements, and the above-mentioned row select lines are treated as gate lines, which connect to the gates of these switching elements, and the above-mentioned effective picture element data is obtained by sequentially selecting all of these source lines and gate lines and charging the above-mentioned respective picture elements, and, in addition, the above-mentioned correction picture element data is obtained without inputting a start signal to either the driving circuit of the above-mentioned gate lines or the driving circuit of the above-mentioned source lines.

Furthermore, the present invention can be constituted such that a highly accurate determination can be made even for an active matrix type display, which does not possess a shift register or address decoder, and source switches or other such horizontal driving circuit inside the above-mentioned device to be inspected, by arranging a driving circuit corresponding to a horizontal driving circuit in a test head outside the above-mentioned device to be inspected, and canceling the input/output capacity and switching resistance irregularities of each component utilized therein.

In an apparatus and method for inspecting the picture elements of an active matrix type display according to the present invention, when inspecting the respective picture elements of a display according to an LCD array and an EL array of an active matrix structure, because effective picture element data is acquired by a so-called charging step and a sensing step (in the present invention, a first sensing step) resulting from the ordinarily performed charging and discharging of each picture element, and, in addition, irregularities in the direction of the source lines of the device to be inspected, and in addition to that, noise originating from device driving signals and irregularities of elements in the measuring device can be canceled by performing a second sensing step in a state, wherein a charge is not applied, and subtracting the correction picture element data obtained at that time, defects in the respective picture elements can be detected directly as-is without irregularities or noise, enabling a polysilicon liquid crystal display or other such active matrix type display to be evaluated with predetermined inspection accuracy.

That is, this picture element inspection commences with a fixed potential charge operation relative to picture elements inside a device to be inspected, such as, for example, a polysilicon liquid crystal display.

This charge operation is generally implemented in point order, that is, in picture element 2 order, in accordance with all procedures and all specifications when a display device portion 3 lights up, from the top left corner to the bottom right corner of the display device portion 3 in FIG. 6.

Next, the charge applied to each picture element 2 is extracted from each picture element 2, and the peak value of the discharge waveform thereof is captured to a memory circuit (in the present invention, the first memory circuit 37 of FIG. 1) (sensing step) (in the present invention, the first sensing step). In this sensing step, picture element data is "effective picture element data."

In this step for sensing a picture element waveform from display device portion 3, the respective picture elements 2 are also accessed in the same order as at charge write time, and the charges of the respective picture elements 2 are generally discharged from the top left corner to the bottom right corner.

In a conventional picture element inspection apparatus and picture element inspection method, a sampling of this discharge waveform was evaluated, and the quality of the respective picture elements 2 was determined.

In the present invention, subsequent to this sensing step (the first sensing step), one line or more of picture element waveforms of inside display device portion 3 are sampled as-is in a state, wherein, for example, no gate lines (row select lines) whatsoever are selected. A picture element waveform captured subsequent to this sensing step comprises data of irregularities of source switches 13 inside the device to be inspected (for example, polysilicon liquid crystal device 1) and noise which is a synthesis of crosstalk components of inside and outside the device to be inspected, and this picture element data is "correction picture element data."

By subtracting line-by-line (row-by-row) correction picture element data from effective picture element data of the device to be inspected obtained via procedures such as these, it is possible to cancel vertical stripe components, which either originate in the irregularities within effective picture element data, or are mixed in with the noise.

Further, when measuring a device with an externally mounted horizontal driving circuit 4, which is typical of an amorphous device, it is possible to reduce the irregularities of parts inside the test head and the crosstalk of various signals from the driving circuits by acquiring effective picture element data and correction picture element data and subtracting these, enabling the implementation, of highly accurate picture element inspection.

Of course, in the present invention, to obtain correction picture element data, instead of sampling as-is one line or more of picture element waveforms in a state, wherein no gate lines (row select lines) are selected, irregularities, noise and crosstalk can be reduced in row select line units of a device to be inspected by sampling as-is one line or more of picture element waveforms in a state, wherein no source lines (column select lines) whatsoever are selected.

Furthermore, as in the third invention and the fourth invention, when the present invention is constituted such that correction picture element data is obtained from the respective picture elements by once again driving both the row select lines and column select lines of the respective picture elements after acquiring effective picture element data, in FIG. 6, for example, if there is a point defect, such as a short-circuited LCD element 6, because both the effective picture element data and the correction picture element data will comprise this point defect, this point defect will be canceled by the subtracting step, and will not be able to be detected, but in the case of a point defect, such as an open circuit LCD element 6, correction picture element data will not comprise this point defect, and this point defect will be able to be detected by the subtracting step.

DESCRIPTION OF THE PREFERRED EMBODIMENTS

Figure 1:
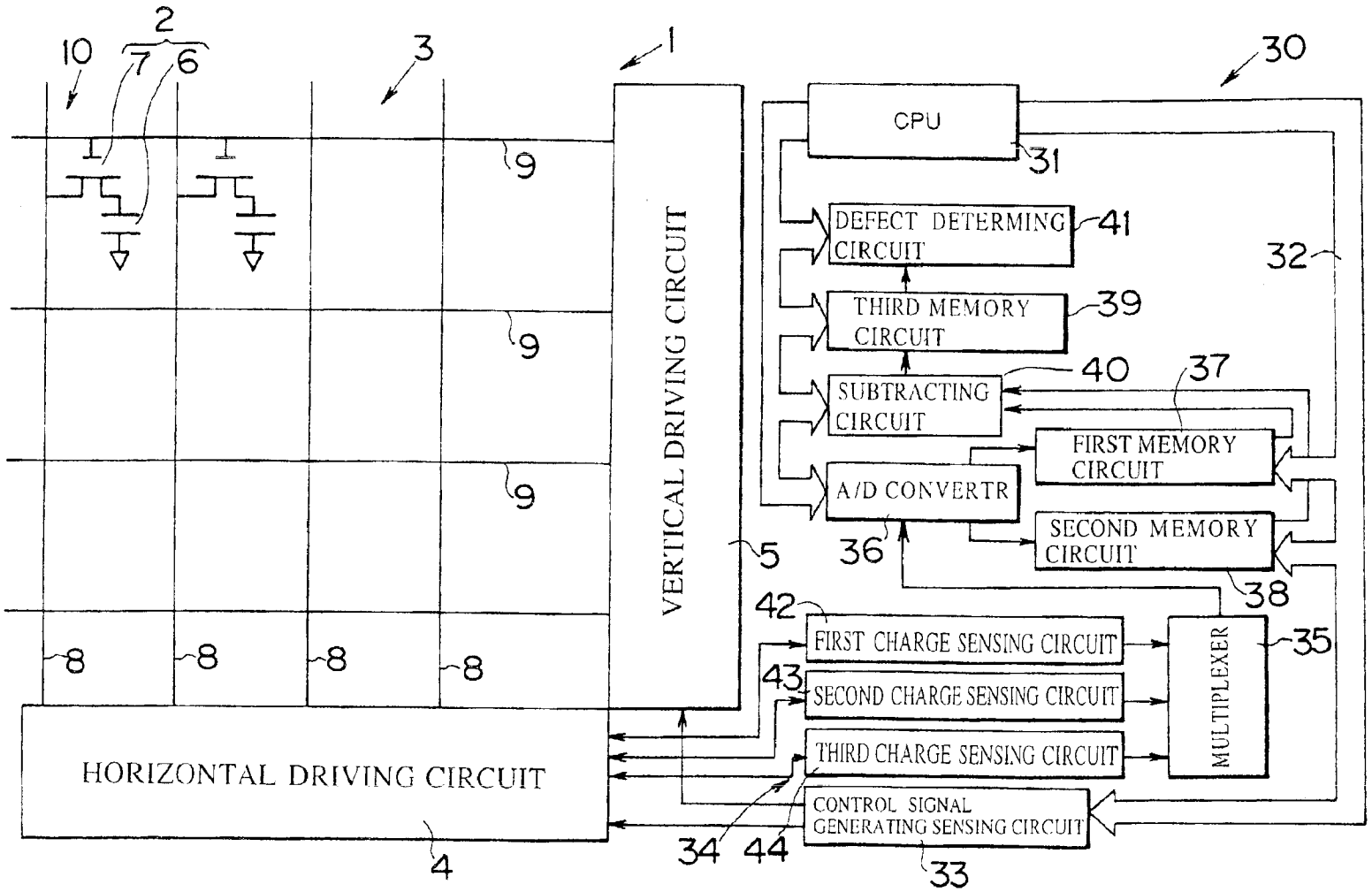
FIG. 1 is a block diagram of an apparatus 30 for inspecting picture elements of an active matrix type display according to an aspect of the embodiment of the present invention.

Next, a picture element inspecting apparatus 30 for an active matrix type display according to aspects of the embodiment of the present invention will be explained together with methods for inspecting these picture elements based on FIG. 1 through FIG. 5. However, the same reference numerals will be assigned to parts that are the same as those in FIG. 6, and detailed explanations thereof will be omitted.

FIG. 1 is a block diagram of a picture element inspection apparatus 30, and picture element inspection apparatus 30 has a central processing unit 31 (CPU), a control bus 32, a control signal generating circuit 33, a charge sensing circuit 34, a multiplexer 35, an A/D converter 36, a first memory circuit 37, a second memory circuit 38, and a third memory circuit 39, a subtracting circuit 40 (arithmetic circuit), and a defect determining circuit 41.

Central processing unit 31 (CPU) controls the entire apparatus via control bus 32.

Control signal generating circuit 33 generates a control signal for the inspection of each picture element 2 of polysilicon liquid crystal display 1, and is connected to horizontal driving circuit 4 and vertical driving circuit 5.

Charge sensing circuit 34 is constituted of a first charge sensing circuit 42 for the R element, a second charge sensing circuit 43 for the G element, and a third charge sensing circuit 44 for the B element, and performs both charging operations and sensing operations for the R element, G element, and. B element.

Multiplexer 35 arranges discharge current waveforms from the first charge sensing circuit 42, the second charge sensing circuit 43, and the third charge sensing circuit 44 in charge sensing circuit 34 into a series and outputs them to A/D converter 36, and A/D converter 36 converts these outputted waveforms from analog to digital.

First memory circuit 37 stores picture element data (effective picture element data) from the respective picture elements 2, which are charged and discharged by driving horizontal driving circuit 4 and vertical driving circuit 5.

Second memory circuit 38 stores picture element data (correction picture element data) from the respective picture elements 2, which is obtained by driving horizontal driving circuit 4 and vertical driving circuit 5 in a state, wherein a vertical start signal Y-ST is not inputted from vertical start signal supply terminal 21 of vertical driving circuit 5.

Subtracting circuit 40 subtracts correction picture element data of second memory circuit 38 from effective picture element data of first memory circuit 37, stores this subtraction data in third memory circuit 39, and, based on this subtraction data, defect determining circuit 41 determines the quality of the respective picture elements 2.

Figure 6:
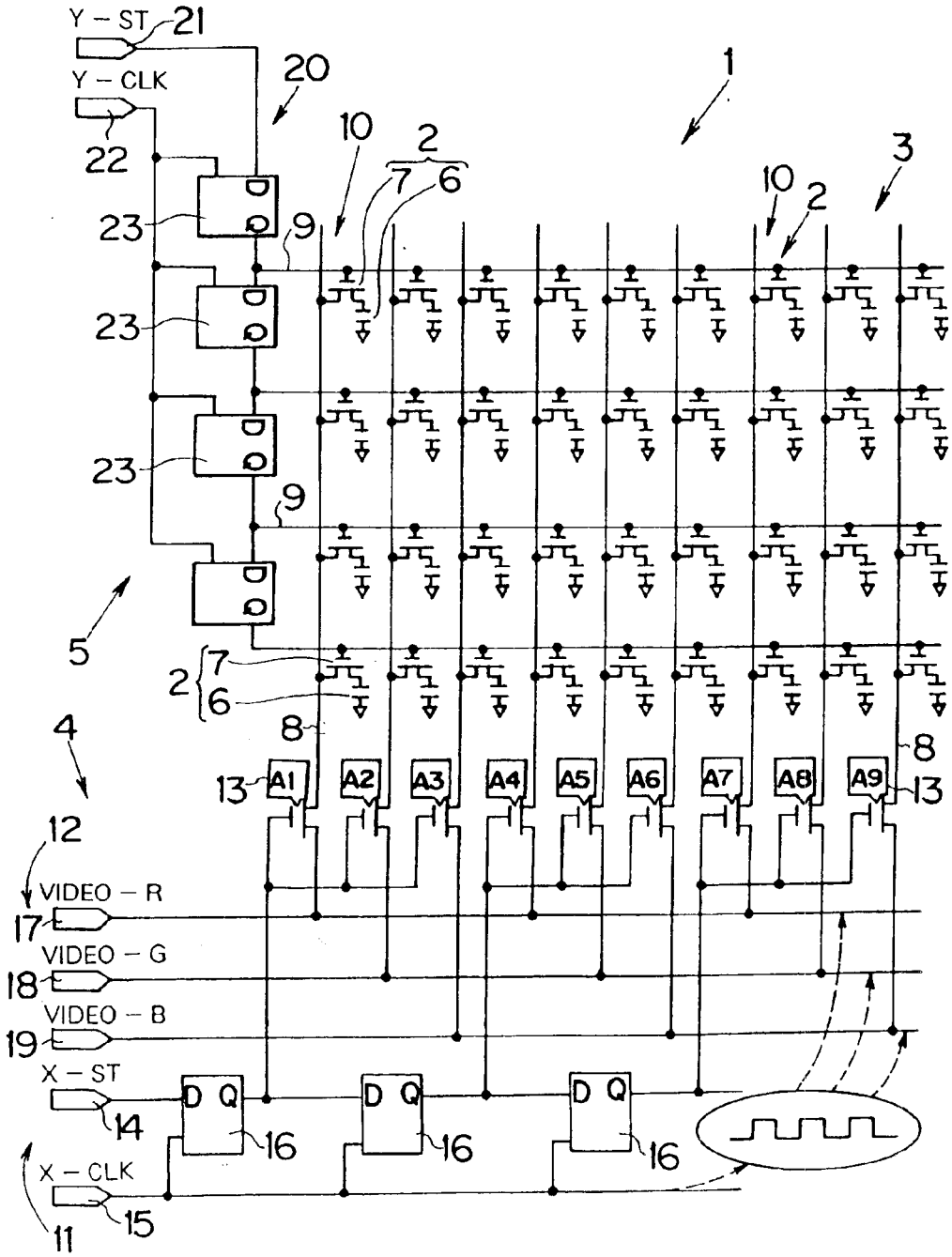
Fig. 6 Prior Art
FIG. 6 is an equivalent circuit diagram of a polysilicon liquid crystal display 1 (active matrix type display) as a device to be inspected.

The respective picture elements 2 of the device to be inspected (polysilicon liquid crystal display 1) of FIG. 6 are evaluated by picture element inspection apparatus 30 of a constitution such as this.

Figure 2:
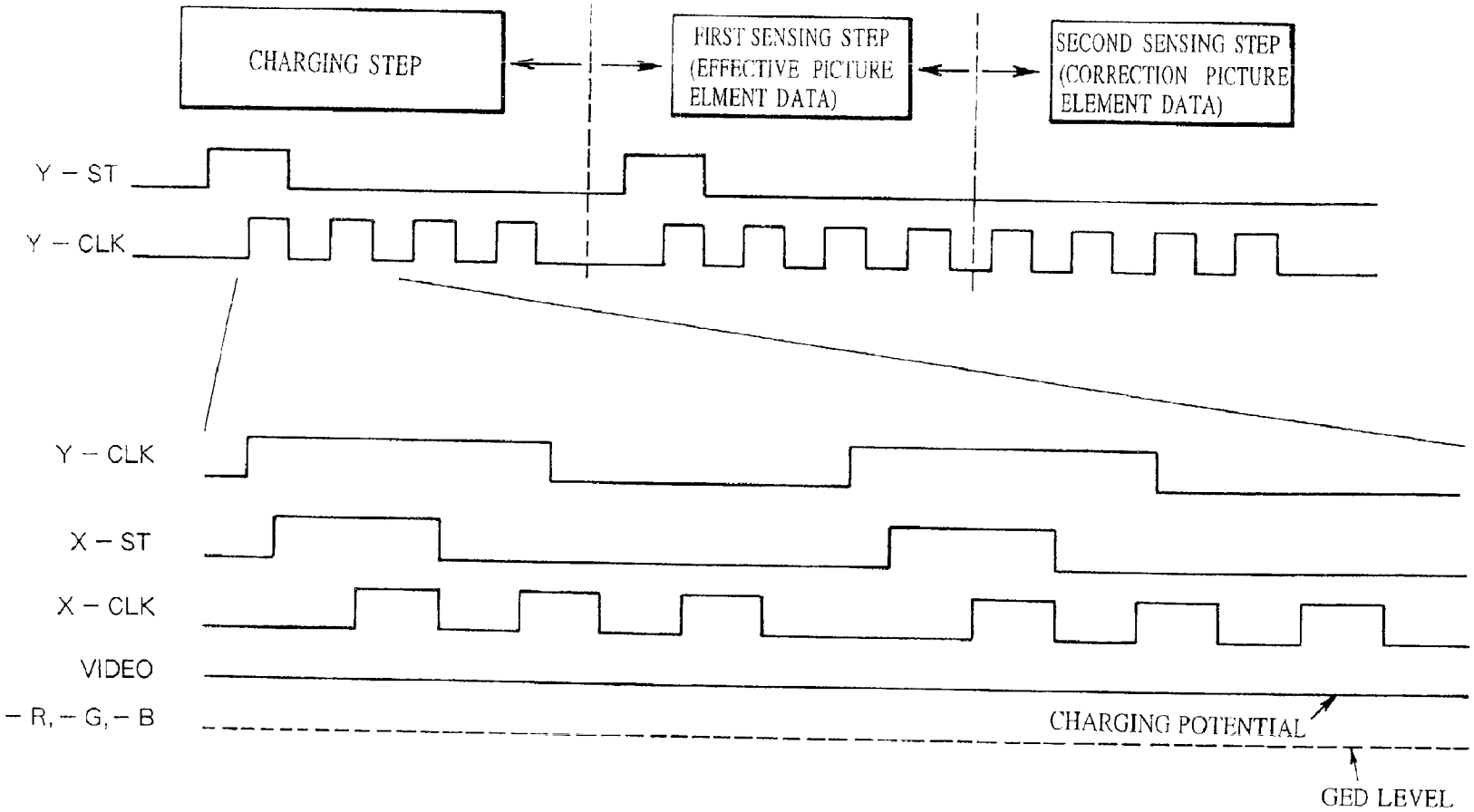
FIG. 2 is a timing chart of the principal charging step in a picture element inspection process by picture element inspection apparatus 30 according to an aspect of the embodiment of the present invention.
Figure 3:
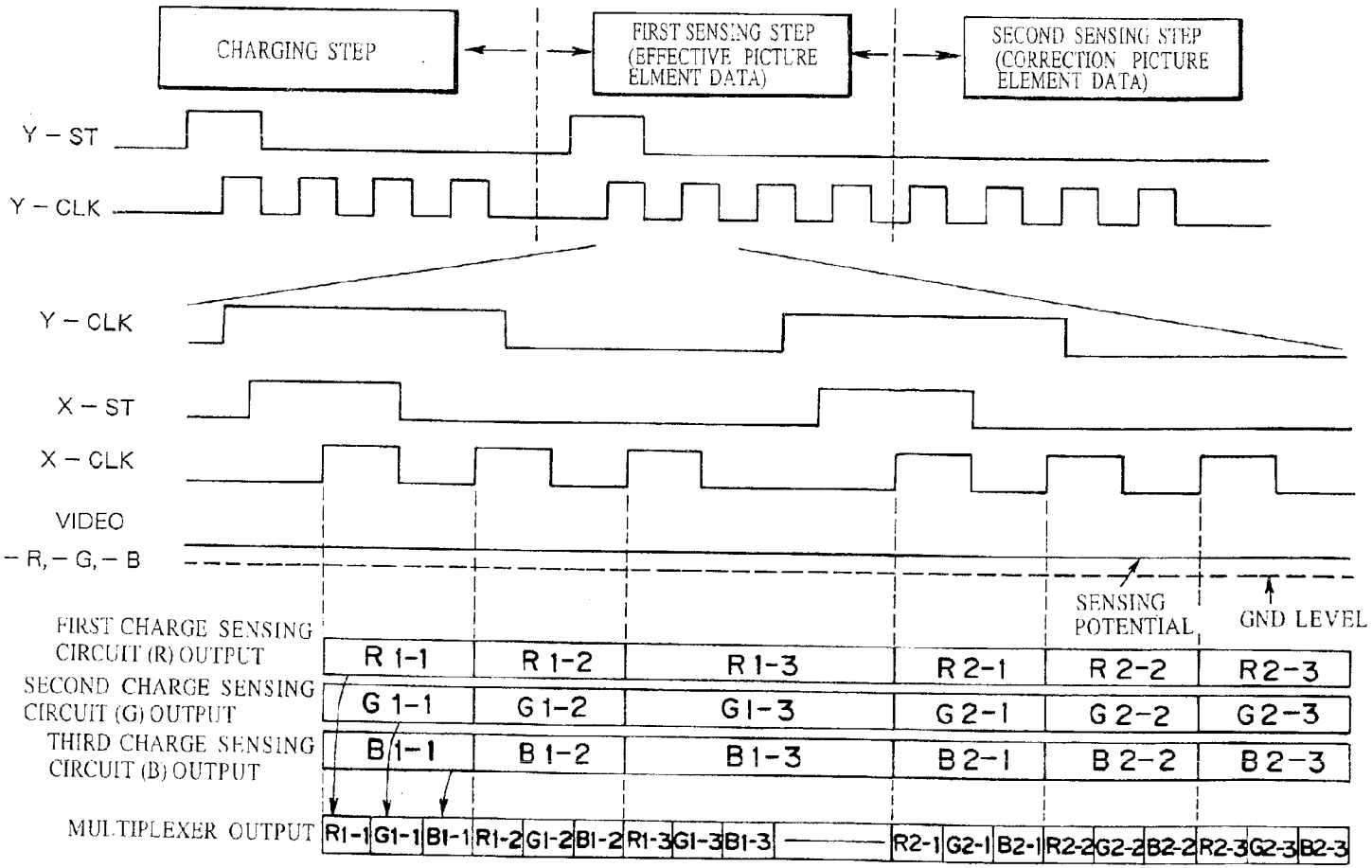
FIG. 3 is a timing chart of the principal sensing steps (a first sensing step and a second sensing step) by picture element inspection apparatus 30 according to an aspect of the embodiment of the present invention.
Figure 4:
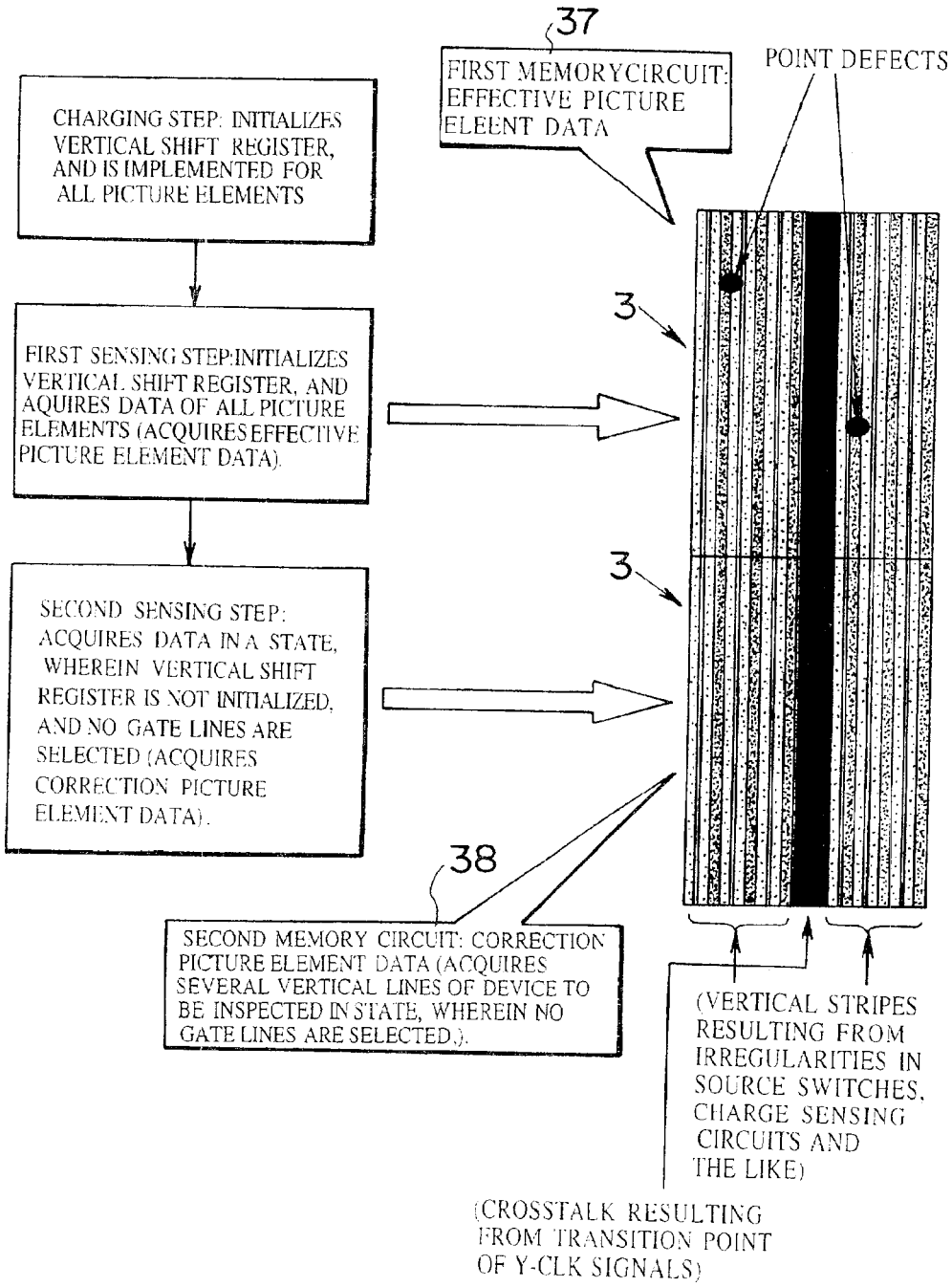
FIG. 4 is a flowchart showing the overall picture element inspection process and examples of picture element data on memory circuits 37, 38 by picture element inspection apparatus 30 according to an aspect of the embodiment of the present invention.

FIG. 2 is a timing chart of the principal charging step in a picture element inspection process according to picture element inspection apparatus 30, FIG. 3 is a timing chart of the principal sensing steps (a first sensing step and a second sensing step) according to picture element inspection apparatus 30, and FIG. 4 is a flowchart showing the overall picture element inspection process and examples of picture element data on memory circuits according to picture element inspection apparatus 30.

First, as for the charging step, a drive signal is generated to polysilicon liquid crystal display 1 by control signal generating circuit 33 (FIG. 1), and supplied to horizontal driving circuit 4 and vertical driving circuit 5. The required drive signals will vary according to the device to be inspected, but in the example of the polysilicon liquid crystal display 1 of FIG. 6, they are drive signals for horizontal driving circuit 4 (horizontal shift register 11), i.e. horizontal start signal X-ST and horizontal clock signal X-CLK, as well as drive signals for vertical driving circuit 5 (vertical shift register 20), i.e. vertical start signal Y-ST and vertical clock signal Y-CLK.

While inputting these horizontal shift register 11 drive signals and vertical shift register 20 drive signals via a normal procedure, a fixed potential (charging potential, FIG. 2) is continuously applied to the R video signal supply terminal 17, G video signal supply terminal 18 and B video signal supply terminal 19 of video signal supply terminal 12, and a fixed potential charge is delivered to all picture elements 2 inside polysilicon liquid crystal display 1.

In particular, as shown in the upper portion of FIG. 2, by initializing vertical shift register 20 by inputting vertical start signal Y-ST into vertical start signal supply terminal 21, and, in addition, inputting a high level signal of 1 clock's worth of vertical clock signals Y-CLK into vertical clock signal supply terminal 22, the first stage of vertical flip-flop circuits 23 for driving the gates of switching elements 7 is made active. In accordance with the driving thereof, the switching elements 7 of all picture elements 2 on the first line in the gate direction transition to a conductive state.

As shown by enlarging the bottom portion of FIG. 2, in this conductive state, by inputting a high level signal of 1 clock's worth of horizontal clock signals X-CLK into horizontal start signal supply terminal 14, the first stage of horizontal flip-flop circuits 16 for driving the source switches 13 is made active the same as in the above-mentioned gate direction.

In accordance with the driving thereof, A1 to A3 of the source switches 13 of FIG. 6 simultaneously transition to a conductive state, and the line potential of R video signal supply terminal 17 is transmitted via a source switch (A1) to the source line 8 on the extreme left side in FIG. 6. The charging potential applied to R video signal supply terminal 17 at this time is ultimately transmitted to the picture element 2 in the upper left-hand corner in FIG. 6 (hereinafter this location will be referred to as "R1-1"), and is stored in the holding capacitance thereof as a charge resulting from a charging operation.

Further, the same driving as described hereinabove is also performed simultaneously for the signal lines of G video signal supply terminal 18 and B video signal supply terminal 19.

In accordance with the driving thereof, a charging potential is also transmitted to the picture element (G1-1) right-adjacent to the above-mentioned picture element 2 (R1-1), and the charge is stored, and furthermore, a charge is also stored in the picture element (B1-1) right-adjacent to the picture element 2 (G1-1).

Here, as shown in FIG. 2, when 1 more clock's worth of horizontal clock signals X-CLK is inputted, the second stage of horizontal flip-flop circuits 16 for driving source switches 13 is activated, causing the source switches (A4–A6) in FIG. 6 to transition to the conductive state.

As a result of this conductive state, due to the fact that the same charging is carried out for the fourth through the sixth picture elements 2 (R1-2, G1-2, B1-2) from the left in the uppermost stage in FIG. 6, and, in addition, source switches 13 (A1–A3) are turned OFF, as for the picture elements (R1-1, G1-1, B1-1) described hereinabove, the movement path of the charges stored therein is blocked, and the charges are held inside the respective holding capacitances (LCD element 6).

Next, as shown in FIG. 2, another 1 clock's worth of horizontal clock signals X-CLK is inputted, the entire horizontal shift register 11 of polysilicon liquid crystal display 1 of FIG. 6 is scanned, and all the picture elements 2 of the one line located in the uppermost stage in FIG. 6 are charged, and thereafter, 1 clock's worth of vertical clock signals Y-CLK is inputted.

In accordance with the inputting of these vertical clock signals Y-CLK, the second stage of vertical shift register 20 of the gate direction becomes active, and all the switching elements 7 of the second line of picture elements 2 in the gate direction transition to the conductive state. Further, for this vertical direction as well, all of the switching elements 7 of the picture elements 2, which were under first-stage control, are turned OFF by the vertical shift register 20 advancing to the next stage the same as the horizontal direction described hereinabove, and the movement path of charges from the respective picture elements 2 is blocked, and even if the potential of each source line 8, which was heretofore in a connected state, changes, the respective picture elements 2 will not be effected.

Thereafter, by repeating the above-described horizontal scanning, the respective picture elements 2 of the second line in the gate direction (R2-1, G2-1, B2-1-R2-3, G2-3, B2-3) are similarly charged in accordance with the potential settings from the respective video signal supply terminals 12.

As for the polysilicon liquid crystal display 1 shown in FIG. 6, since the vertical direction has 4 lines (4 rows), this series of sequences is executed in 4 lines, that is, 4 clock's worth of vertical clock signals Y-CLK, and all the picture elements 2 are charged at a fixed potential (charge potential) of a predetermined set level.

The above step is part of the charging step in FIG. 2 and FIG. 4.

Following this charging step, the apparatus enters sensing steps (first sensing step, second sensing step) for reading out a charge written to a picture element 2.

In the first sensing step, as shown in FIG. 3, drive waveform signals to horizontal shift register 11 and vertical shift register 20 are the same as in the case of the charging step explained using FIG. 2, the only difference being that, from the perspective of the terminal portion of polysilicon liquid crystal display 1, only a set potential is applied to the respective video lines of the video signal supply terminal 12.

That is, the bias setting of a video line during a sensing step is set at a low potential (sensing potential, FIG. 3) relative to the charging potential during a charging step, the potential difference thereof is used, and a charge written to a picture element 2 by a charging step is read out by a sensing step, and the current waveform thereof is supplied to charge sensing circuit 34.

As shown in FIG. 3, since a discharge current from a corresponding picture element 2 flows into the test head (picture element inspection apparatus 30) via a video line each time a horizontal clock signal X-CLK pulse is inputted to horizontal clock signal supply terminal 15, this current waveform is converted from a current to a voltage in the first charge sensing circuit 42, second charge sensing circuit 43, and third charge sensing circuit 44 of charge sensing circuit 34 in FIG. 1.

In polysilicon liquid crystal display 1 shown in FIG. 6, since there are three terminals, R video signal supply terminal 17, G video signal supply terminal 18, and B video signal supply terminal 19, as video signal supply terminal 12, at each inputting of a clock pulse (horizontal clock signal X-CLK) to horizontal clock signal supply terminal 15, three picture element's worth of data are simultaneously outputted one picture element at a time from the respective video lines of R video signal supply terminal 17, G video signal supply terminal 18, and B video signal supply terminal 19.

Therefore, in the picture element inspection apparatus 30 of FIG. 1, a multiplexer 35 is disposed in the next stage of charge sensing circuit 34, time division multiplexing, by which the data of three picture elements is switched over within 1 clock cycle of a horizontal clock signal X-CLK, is performed, and serialized data is outputted to A/D converter 36.

The bottom part of FIG. 3 shows a timing chart of time division multiplexing by multiplexer 35, and picture element data simultaneously extracted from R video signal supply terminal 17, G video signal supply terminal 18, and B video signal supply terminal 19 is multiplexed in the order of an R video signal, G video signal, and finally a B video signal.

Thus, the discharge current waveform of a charge from each picture element 2 detected by charge sensing circuit 34 is serialized by multiplexer 35, digitalized by A/D converter 36, and stored in first memory circuit 37.

The above step is the first sensing step (effective picture element data acquiring step) in FIG. 3 and FIG. 4.

Vertical stripes are captured to the above-mentioned first memory circuit 37 as a result of source switch 13 irregularities, horizontal clock signal X-CLK crosstalk, and the characteristic irregularities of three-system charge sensing circuit 34, and a picture element 2 point defect is captured in a form, which is superimposed on this vertical stripe component. Furthermore, in the case of the device to be inspected of FIG. 6 (polysilicon liquid crystal display 1), data of nine picture elements should be lined up in the horizontal direction as vertical stripes, but in the data capture example of FIG. 4, it shows that more numerous picture elements than those captured from the polysilicon liquid crystal display 1 (FIG. 6) are lined up in the horizontal direction and the vertical direction.

In the present invention, a second sensing step is performed following the first sensing step of FIG. 4.

In the second sensing step, the acquisition of additional data (correction picture element data) from polysilicon liquid crystal display 1 continues in a state, wherein a start pulse (vertical start signal Y-ST) is not inputted to vertical shift register 20, that is, without initializing vertical shift register 20 and with no gate lines 9 (row select lines) whatsoever being selected.

In the timing chart of FIG. 3, in the part of the second sensing step (correction picture element data) that acquires this data, with the exception of not inputting a vertical start signal Y-ST pulse to vertical start signal supply terminal 21, a drive signal, which is exactly the same as the drive signal waveform for acquiring data of the effective picture element data part in the first sensing step, is applied, and data acquisition continues in a state, wherein a charge is not applied to the respective picture elements 2.

In this second sensing step (correction picture element data), since the output of all the vertical flip-flop circuits 23 inside vertical shift register 20 is low, it is a state, wherein no gate lines 9 whatsoever are active, and in this state, only vertical stripe components of inside captured images of picture element data, which are generated by source switch 13 irregularities, horizontal clock signal X-CLK crosstalk, and charge sensing circuit 34 irregularities, are acquired by scanning performed by the horizontal driving circuit 4 alone.

In this second sensing step, when even the vertical shift register 20 drive clock signal (vertical clock signal Y-CLK)

stops, since there is the danger of losing the effect on the captured image by a clock waveform transition point, i.e. either a rising edge or a falling edge, it is important that only the supply of the start pulse (vertical start signal Y-ST) to vertical shift register 20 be stopped, and that the drive clock signal be maintained in the same state as in the first sensing step.

The above step is the second sensing step (correction picture element data) in FIG. 3 and FIG. 4.

FIG. 4 shows an example of correction picture element data acquired by this second sensing step together with an example of effective picture element data in the first sensing step.

In FIG. 4, the present invention is constituted such that the same storage capacity as that of the first memory circuit 37 is assigned to the second memory circuit 38, and as much as several picture element's worth of correction picture element data of polysilicon liquid crystal display 1 can be captured, and such that the contents of the second memory circuit 38 can simply be subtracted from the contents of the first memory circuit 37 by subsequent image processing operations.

However, because the vertical shift register 20 stops, since practically the same contents are repeatedly captured in all lines (source lines 8 or column select lines), a storage space of the same capacity as that of first memory circuit 37 need not be allocated for the contents of the second memory circuit 38, and so long as there is at the least one horizontal line's (gate line 9 or row select line) worth of storage space, the effects of the present invention can be obtained.

The same vertical stripe components as those stored in first memory circuit 37 are comprised in the correction picture element data obtained in the second sensing step, and because the vertical shift register 20 is not operating, most of the picture element defect information captured to first memory circuit 37 is not captured to second memory circuit 38.

That is, only vertical stripe components having as their source of origin source switch 13 irregularities and the like, which are superimposed on the discharge current from a picture element 2 of polysilicon liquid crystal display 1, are captured to second memory circuit 38.

Figure 5:
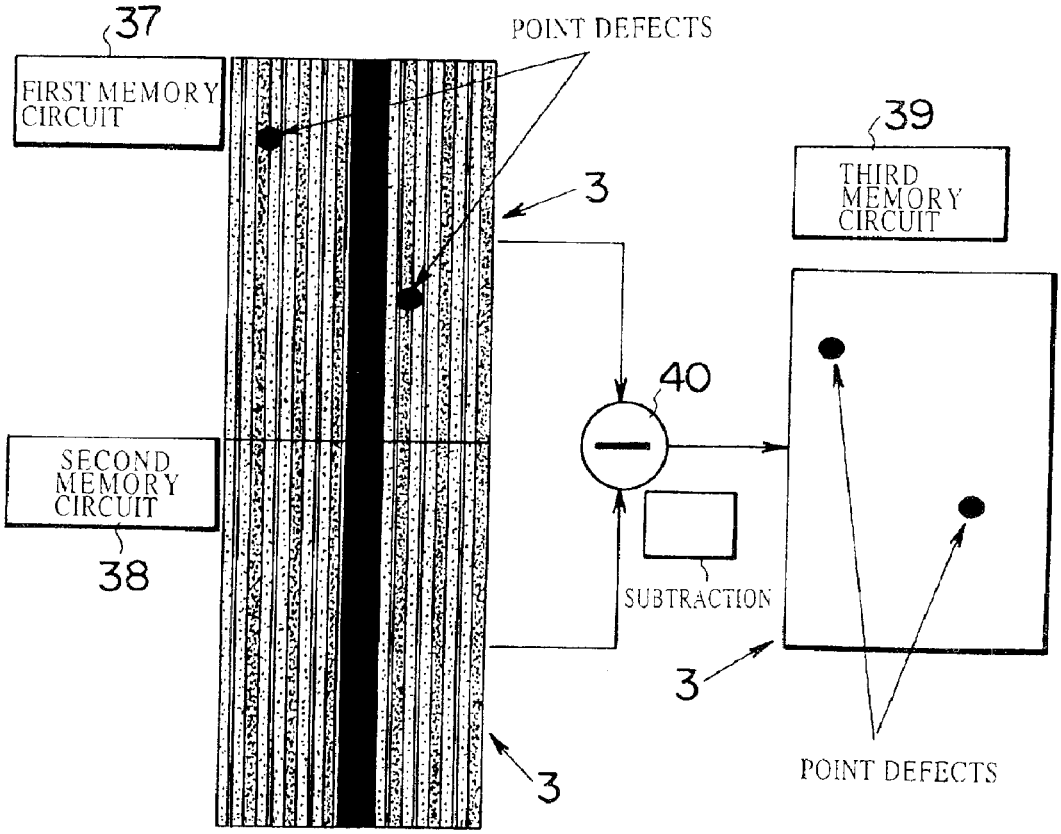
FIG. 5 is a simplified schematic diagram showing a subtracting step in a subtracting circuit 40 by picture element inspection apparatus 30 according to an aspect of the embodiment of the present invention.

FIG. 5 is a simplified schematic diagram showing a subtracting step in subtracting circuit 40, and as shown in the figure, vertical stripe components, which have a serious impact on subsequent defect determinations, are superimposed in raw data in which discharge current captured to first memory circuit 37 is digitalized, and therefore constitute an impediment to a highly accurate determination, but in the present invention, subtracting the vertical stripe components (correction picture element data), which are captured to second memory circuit 38, from the effective picture element data of first memory circuit 37 makes it possible to remove vertical stripe components that effect a picture element 2 defect determination.

The result of this subtracting step is stored in third memory circuit 39. That is, as indicated by the picture element data image on the right side of FIG. 5, correction picture element data stored at the same coordinates inside second memory circuit 38 is subtracted from raw effective picture element data stored in first memory circuit 37 (subtracting step), and the results thereof are stored at corresponding coordinates in the display device portion 3.

In this post-correction data inside third memory circuit 39, the vertical stripe components, which constituted a problem in the data inside first memory circuit 37, are canceled, and the point defects to be inspected appear in sharp relief.

A more highly accurate defect determination can be achieved by the defect determining circuit 41 making a determination on this post-correction data inside third memory circuit 39.

Furthermore, in this aspect of the embodiment, the example given was of a picture element inspection of a polysilicon liquid crystal display 1 according to a typical polysilicon LCD array of an active matrix structure, but in the present invention, when a device with an externally mounted driving circuit, which is typical in an amorphous silicon LCD array of an active matrix structure, is to be inspected, the contents of the present invention can be implemented by disposing the horizontal driving circuit 4 and vertical driving circuit 5 of FIG. 1 in the test head side (that is, the side of picture element inspection apparatus 30).

Furthermore, in this aspect of the embodiment, implementing a highly accurate picture element inspection was made possible mainly by canceling the irregularities of source switches 13, the crosstalk of, for example, horizontal clock signals X-CLK originating in drive signals, or, for example, the irregularities of charge sensing circuit 34 in the measurement system, by acquiring correction picture element data in a state, wherein vertical shift register 20 is not initialized, and no gate lines 9 (row select lines) whatsoever are selected, but in the present invention, by contrast, source switch 13 irregularities cannot be canceled by acquiring correction picture element data in a state, wherein horizontal shift register 11 is not initialized, and no source lines 8 (column select lines) whatsoever are selected, but the canceling of either vertical clock signal Y-CLK crosstalk, or charge sensing circuit 34 irregularities is possible, and a highly accurate picture element inspection can be performed in accordance with a desire to inspect picture elements.

Further, as in the third invention and fourth invention in particular, subsequent to acquiring effective picture element data, in the second sensing step of FIG. 3, for example, unlike the aspects of the embodiment described hereinabove, when the present invention is constituted such that a vertical start signal Y-ST is inputted to vertical shift register 20, and correction picture element data is obtained from the respective picture elements 2 by once again driving both the gate lines 9 and source lines 8 of the respective picture elements 2, if there is a point defect, such as a short circuited LCD element 6 in FIG. 6, for example, since both effective picture element data and correction picture element data comprise signal waveforms resulting from this point defect, this point defect will be deleted by a subtracting step, making detection impossible, but in the case of a point defect, such as an open circuit LCD element 6, because correction picture element data does not comprise this point defect, this point defect can be detected by a subtracting step.

As described hereinabove, according to the present invention, since a subtracting step is performed on effective picture element data comprising both point defects and noise caused by irregularities of the device to be inspected, and correction picture element data comprising only noise caused by irregularities of the device to be inspected, it is possible to determine defects in picture elements (point defects) while canceling these irregularities or noise, and a highly accurate picture element inspection can be realized with a simple apparatus or method.

What is claimed is:

1. A picture element inspecting apparatus for an active matrix type display board, for determining the quality of picture elements of a device to be inspected that is the active matrix type display board in which the picture elements are arranged at the respective intersecting portions of a plurality of column select lines and a plurality of row select lines into a matrix shape and the picture elements can be driven by a horizontal driving circuit and a vertical driving circuit, wherein a subtraction operation is performed on effective picture element data obtained as a discharge waveform from said picture elements by electrically charging said picture elements of said device to be inspected using said horizontal driving circuit and said vertical driving circuit, and correction picture element data obtained from said picture elements in a state where either said row select lines or said column select lines of the picture elements are not selected after acquiring said effective picture element data, and the quality of said picture elements is determined based on this subtraction output thus obtained.

2. The picture element inspecting apparatus for an active matrix type display board according to claim 1, wherein the effects of horizontal start signals and horizontal clock signals in said column select lines, and the effects of vertical clock signals in said row select lines inside said device to be inspected can be simultaneously canceled.

3. The picture element inspecting apparatus for an active matrix type display board according to claim 1, wherein the effects of horizontal clock signals in said column select lines, and the effects of vertical start signals and vertical clock signals in said row select lines inside said device to be inspected can be simultaneously canceled.

4. The picture element inspecting apparatus for an active matrix type display board according to claim 1, wherein:

said picture elements have thin-film transistor switching elements, respectively:

said column select lines are regarded as source lines, which connect to the sources of the switching elements, and said row select lines are regarded as gate lines, which connect to the gates of the switching elements;

said effective picture element data is obtained by sequentially selecting all of these source lines and gate lines, and electrically charging said picture elements; and said correction picture element data is obtained without inputting a start signal to either of driving circuit of said gate lines or driving circuit of said source lines.

5. The picture element inspecting apparatus for an active matrix type display board according to claim 1, wherein the board is installed into an active matrix type display.

6. The picture element inspecting apparatus for an active matrix type display board according to claim 1, wherein the correction picture element data are obtained from said row select lines in a state where said column select lines of the picture elements are not selected after acquiring said effective picture element data.

7. A picture element inspecting apparatus for an active matrix type display board, for determining the quality of picture elements of a device to be inspected that is the active matrix type display board in which the picture elements are arranged at the respective intersecting portions of a plurality of column select lines and a plurality of row select lines into a matrix shape and the picture elements can be driven by a horizontal driving circuit and a vertical driving circuit, said picture element inspecting apparatus comprising:

a subtracting circuit for performing a subtraction operation on effective picture element data from said picture elements driven by said driving circuits and correction picture element data obtained by driving the picture elements in a state where either said row select lines or said column select lines of the picture elements are not selected; and a defect determining circuit for determining the quality of the picture elements based on the subtraction output from this subtracting circuit.

8. The picture element inspecting apparatus for an active matrix type display board according to claim 7, wherein the effects of horizontal drive signals and horizontal clock signals in said column select lines, and the effects of vertical clock signals in said row select lines inside said device to be inspected can be simultaneously canceled.

9. The picture element inspecting apparatus for an active matrix type display board according to claim 7, wherein the effects of horizontal clock signals in said column select lines, and the effects of vertical drive signals and vertical clock signals in said row select lines inside said device to be inspected can be simultaneously canceled.

10. The picture element inspecting apparatus for an active matrix type display board according to claim 7, wherein the board is installed into an active matrix type display.

11. The picture element inspecting apparatus for an active matrix type display board according to claim 7, wherein the correction picture element data are obtained from said row select lines in a state where said column select lines of the picture elements are not selected after acquiring said effective picture element data.

12. A picture element inspecting apparatus for an active matrix type display board, for determining the quality of picture elements of a device to be inspected that is the active matrix type display board in which the picture elements are arranged at the respective intersecting portions of a plurality of column select lines and a plurality of row select lines into a matrix shape and the picture elements can be driven by a horizontal driving circuit and a vertical driving circuit, wherein a subtraction operation is performed on effective picture element data obtained as a discharge waveform from said picture elements by electrically charging said picture elements of said device to be inspected using said horizontal driving circuit and said vertical driving circuit, and correction picture element data obtained as a signal waveform resulting from a reason other than the electric discharge from said picture elements by once again driving both said row select lines and said column select lines of the picture elements, without carrying out said charging operation after acquiring the effective picture element data, and the quality of said picture elements is determined based on the subtraction output thus obtained.

13. The picture element inspecting apparatus for an active matrix type display board according to claim 12, wherein the board is installed into an active matrix type display.

14. A picture element inspecting apparatus for an active matrix type display board, for determining the quality of picture elements of a device to be inspected that is the active matrix type display board in which the picture elements are arranged at the respective intersecting portions of a plurality of column select lines and a plurality of row select lines into a matrix shape and the picture elements can be driven by a horizontal driving circuit and a vertical driving circuit, said picture element inspecting apparatus comprising:

a subtracting circuit for performing a subtraction operation on effective picture element data from said picture elements obtained as a discharge waveform by electrically charging said picture elements using the driving circuits, and correction picture element data obtained by once again driving both said row select lines and said column select lines of the picture elements without carrying out said charging operation after acquiring said effective picture element data; and a defect determining circuit for determining the quality of said picture elements based on the subtraction output from this subtracting circuit.

15. A The picture element inspecting apparatus for an active matrix type display board according to claim 14, wherein the board is installed into an active matrix type display.

16. A picture element inspecting apparatus for an active matrix type display board, for determining the quality of picture elements of a device to be inspected that is the active matrix type display board in which the picture elements are arranged at the respective intersecting portions of a plurality of column select lines and a plurality of row select lines into a matrix shape and the picture elements can be driven by a horizontal driving circuit and a vertical driving circuit, said picture element inspecting apparatus comprising:

an A/D converter for performing analog-to-digital conversion of signals from said device to be inspected, which is driven by said driving circuits;

a first memory circuit for holding effective picture element data converted from analog to digital by the A/D converter, the picture element data being obtained as a discharge waveform from said picture elements by electrically discharging said picture elements of said device to be inspected using said horizontal driving circuit and said vertical driving circuit;

a first memory circuit for holding at the least one line's worth or more of correction picture element data converted from analog to digital by the A/D converter, the correction picture element data being obtained from said picture elements in a state where either said row select lines or said column select lines of the picture elements are not selected after acquiring said effective picture element data; and an arithmetic circuit for calculating picture element data stored in the first and second memory circuits, wherein the quality of picture elements is determined while canceling irregularities originating in either the direction of said column select lines or the direction of said row select lines in said device to be inspected.

17. The picture element inspecting apparatus for an active matrix type display board according to claim 16, wherein effects of horizontal drive signals and horizontal clock signals in said column select lines, and the effects of vertical clock signals in said row select lines inside said device to be inspected can be simultaneously canceled.

18. The picture element inspecting apparatus for an active matrix type display board according to claim 16, wherein the effects of horizontal clock signals in said column select lines, and the effects of vertical drive signals and vertical clock signals in said row select lines inside said device to be inspected can be simultaneously canceled.

19. The picture element inspecting apparatus for an active matrix type display board according to claim 7, wherein:

said picture elements have thin-film transistor switching elements, respectively:

said column select lines are regarded as source lines, which connect to the sources of the switching elements, and said row select lines are regarded as gate lines, which connect to the gates of the switching elements;

said effective picture element data is obtained by sequentially selecting all of these source lines and gate lines, and electrically charging said picture elements; and said correction picture element data is obtained without inputting a start signal to either of driving circuit of said gate lines or driving circuit of said source lines.

20. The picture element inspecting apparatus for an active matrix type display board according to claim 16, wherein:

said picture elements have thin-film transistor switching elements, respectively:

said column select lines are regarded as source lines, which connect to the sources of the switching elements, and said row select lines are regarded as gate lines, which connect to the gates of the switching elements;

said effective picture element data is obtained by sequentially selecting all of these source lines and gate lines, and electrically charging said picture elements; and said correction picture element data is obtained without inputting a start signal to either of driving circuit of said gate lines or driving circuit of said source lines.

21. The picture element inspecting apparatus for an active matrix type display board according to claim 16, wherein the board is installed into an active matrix type display.

22. The picture element inspecting apparatus for an active matrix type display board according to claim 16, wherein the correction picture element data are obtained from said row select lines in a state where said column select lines of the picture elements are not selected after acquiring said effective picture element data.

23. A picture element inspecting method for an active matrix type display board, for determining the quality of picture elements of a device to be inspect that is the active matrix type display board in which the picture elements are arranged at the respective intersecting portions of a plurality of column select lines and a plurality of row select lines into a matrix shape and the picture elements can be driven by a horizontal driving circuit and a vertical driving circuit, said picture element inspecting method comprising the steps of:

performing a subtraction operation on effective picture element data obtained as a discharge waveform from said picture elements by electrically charging said picture elements of said device to be inspected using said horizontal driving circuit and said vertical driving circuit, and correction picture element data obtained from said picture elements in a state where either said row select lines or said column select lines of said picture elements are not selected after acquiring the effective picture element data; and determining the quality of said picture elements based on the subtraction output thus obtained.

24. The picture element inspecting method for an active matrix type display board according to claim 23, wherein the board is installed into an active matrix type display.

25. The picture element inspecting method for an active matrix type display board according to claim 23, wherein the correction picture element data are obtained from said row select lines in a state where said column select lines of the picture elements are not selected after acquiring said effective picture element data.

26. A picture element inspecting method for an active matrix type display board, for determining the quality of picture elements of a device to be inspected that is the active matrix type display board in which the picture elements are arranged at the respective intersecting portions of a plurality of column select lines and a plurality of row select lines into a matrix shape and the picture elements can be driven by a horizontal driving circuit and a vertical driving circuit, said picture element inspecting method comprising:

a charging step for electrically charging said picture elements of said device to be inspected using said horizontal driving circuit and said vertical driving circuit;

a first sensing step for acquiring effective picture element data from said picture elements following this charging step;

a second sensing step for acquiring correction picture element data in a state where either said row select lines or said column select lines of said picture elements are not selected;

a subtracting step for performing a subtraction operation on said effective picture element data in said first sensing step and said correction picture element data in said second sensing step; and a determining step for determining the quality of said picture elements based on the subtraction output obtained in this subtracting step.

27. The picture element inspecting method for an active matrix type display board according to claim 26, wherein the board is installed into an active matrix type display.

28. The picture element inspecting method for an active matrix type display board according to claim 26, wherein the correction picture element data are obtained from said row select lines in a state where said column select lines of the picture elements are not selected after acquiring said effective picture element data.

* * * * *